US005343375A

United States Patent [19]

Gross et al.

[11] Patent Number: 5,343,375

[45] Date of Patent: Aug. 30, 1994

[54] EMERGENCY EGRESS ILLUMINATOR AND MARKER LIGHT STRIP

[75] Inventors: H. Gerald Gross, Santa Ana, Calif.; Stephen B. Oliver, Worthing, United Kingdom

[73] Assignee: H. Koch & Sons Company, Anaheim, Calif.

[21] Appl. No.: 984,707

[22] Filed: Jan. 28, 1993

[51] Int. Cl.[5] ..... F21V 1/00

[52] U.S. Cl. ..... 362/248; 362/153; 362/240; 362/800

[58] Field of Search ..... 362/800, 240, 238, 227, 362/248, 249, 147, 153

[56] References Cited

U.S. PATENT DOCUMENTS

| | | | |
|---|---|---|---|
| 4,597,033 | 6/1986 | Meggs et al. | 362/183 |
| 4,600,975 | 7/1986 | Roberts | 362/240 |
| 4,682,147 | 7/1987 | Bowman | 340/286 R |
| 4,884,178 | 11/1989 | Roberts | 362/241 |
| 5,038,255 | 8/1991 | Nishihashi et al. | 362/800 |
| 5,099,401 | 3/1992 | Kondo et al. | 362/240 |
| 5,103,382 | 4/1992 | Kondo et al. | 362/800 |
| 5,130,909 | 7/1992 | Gross | 362/153 |

*Primary Examiner*—Carroll B. Dority
*Attorney, Agent, or Firm*—David A. Greenlee

[57] ABSTRACT

An emergency lighting strip provides for illumination of the floor of an emergency egress passageway during clear air conditions and also marks an escape path during conditions of limited visibility. The strip mounts two strings of narrow cone L.E.D.s in a transparent tubular housing which is mounted on the passageway wall. The marker string mounts L.E.D.s at half-inch intervals with their beam axes aimed at the middle of the passageway floor. The illuminator string mounts L.E.D.s at four-inch intervals with their beam axes angled above horizontal. A strip of the half-inch spaced L.E.D.s, with the L.E.D. beam axes perpendicular to the wall is mounted to frame and mark an exit doorway.

31 Claims, 2 Drawing Sheets

FIG 1
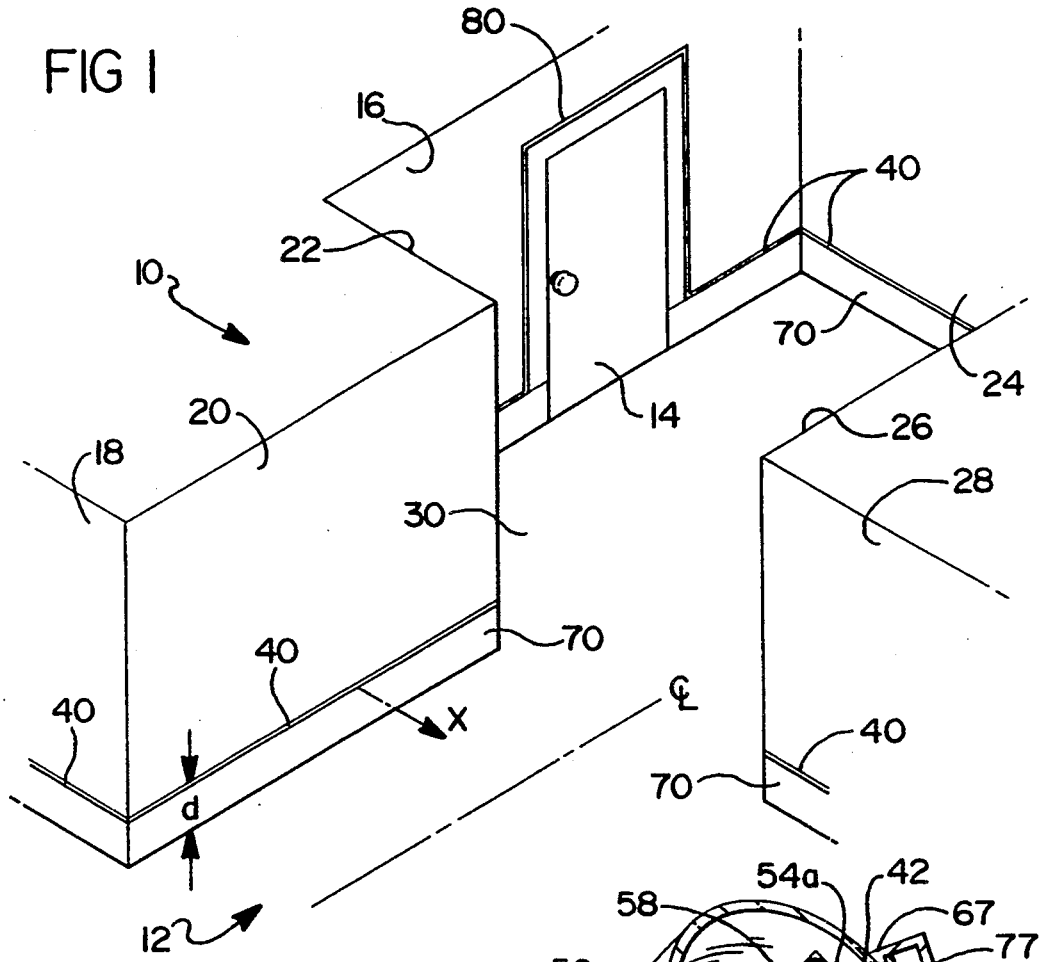
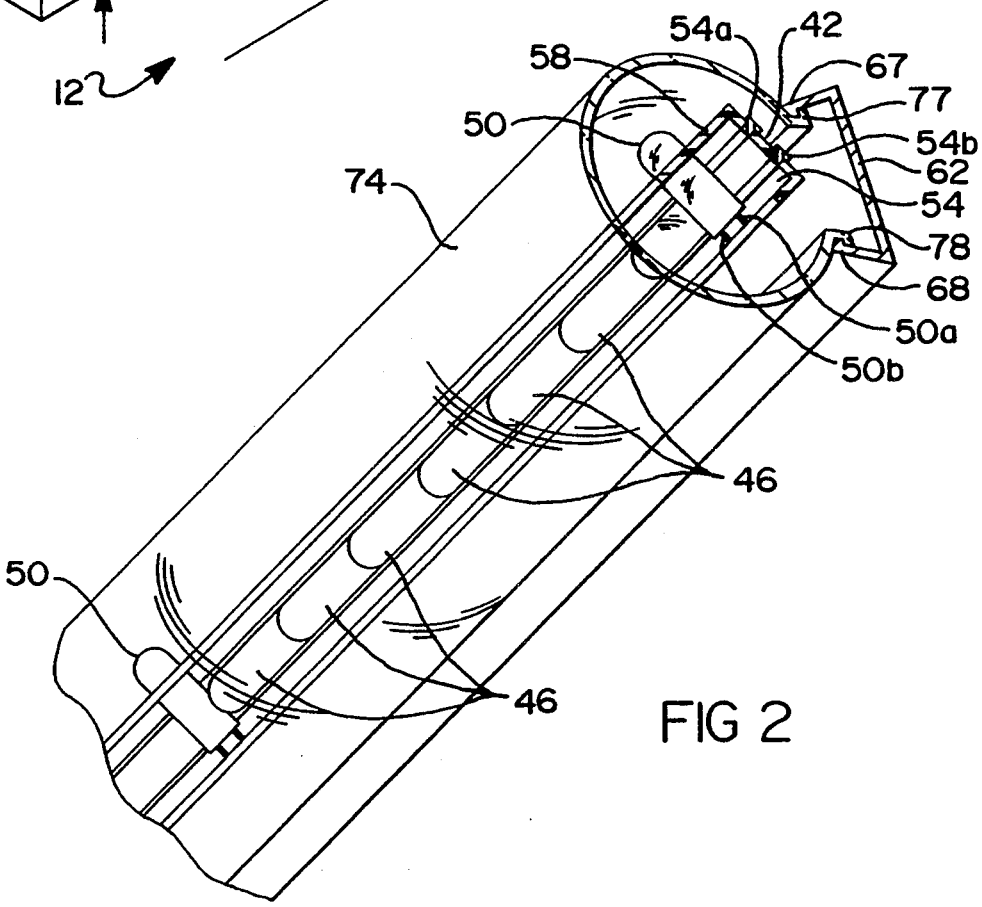
FIG 2

FIG 3
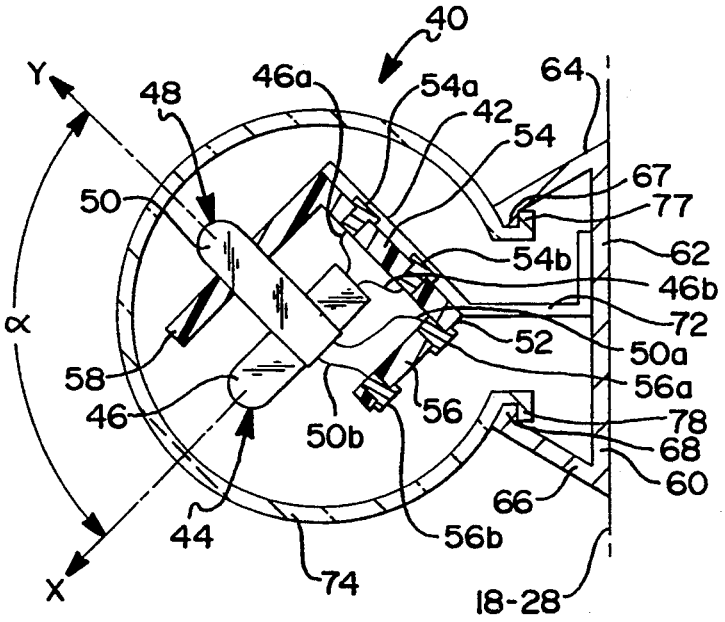
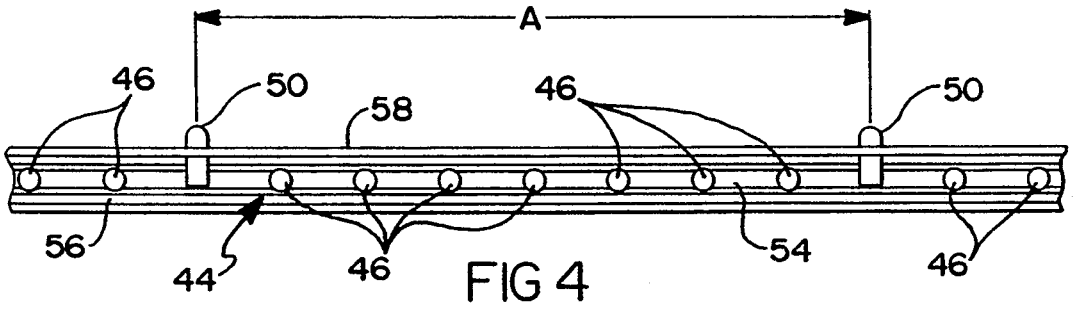
FIG 4
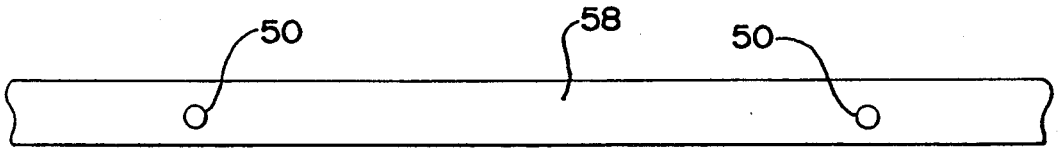
FIG 5

EMERGENCY EGRESS ILLUMINATOR AND MARKER LIGHT STRIP

FIELD OF THE INVENTION

This invention relates generally to emergency lighting and, more particularly, to an emergency lighting aid for illuminating an emergency egress passageway in emergency clear air conditions and for guiding the egress of occupants along a path through the passageway during reduced visibility conditions.

BACKGROUND OF THE INVENTION

Many different types of lighting aids and systems have been devised and used to provide emergency lighting for use in buildings, aircraft and ships when conditions render normal ambient lighting insufficient for visibility. Such conditions include power outages, smoke caused by fires, water immersion, and chemical fog.

One such system operable upon aircraft water immersion is disclosed in U.S. Pat. No. 4,597,033 to Meggs et al and assigned to the assignee herein. This system utilizes light emitting diodes (L.E.D.s) to form a strip which illuminates the outline of an egress hatch in a helicopter when it is submerged in water and is effective in conditions of considerable turbidity.

Another system, shown in U.S. Pat. No. 4,682,147 to Bowman, utilizes a plurality of L.E.D.s in an "EXIT" sign. The sign is illuminated during power failure to indicate a means of egress to confined occupants.

"EXIT" signs are a common sight in theaters, office buildings, stores, subways and other confining structures frequented by the public. Such signs are commonly illuminated by conventional incandescent light bulbs or, as illustrated in the Bowman patent, by L.E.D.s. The light sources in these signs emit their light spherically or hemispherically. Adequacy of these signs is frequently measured by their brightness, which is often equated to their visibility under emergency conditions.

However, this brightness standard is now being questioned, since, under conditions of visibility impaired by the presence of smoke or fog, this brightness can become a handicap. This is caused by diffusion of the light by the particles comprising the smoke or fog. As the distance between the observer and the lighted sign increases, the distinctness of the letters, then the sign itself, rapidly diminishes until only a general glow is distinguishable.

Also, as distance from the sign increases and as the light becomes scattered by the particulate matter, the source of the light becomes indistinguishable from the scattered light itself. Thus, the light source is no longer discernable at all. Unfortunately, a significant increase in light intensity increases the range of visibility only slightly. Thus, a very bright conventional sign becomes useless at a very short distance from it in dense smoke conditions which severely limit visibility.

Light strips are now being provided along aisles of airplanes to mark an emergency egress route. These comprise spaced light sources that suffer the same general visibility problems as the signs, being subject to rapid light diffusion in smoke conditions. These light strips improve over signs, since they provide a light source that is closer to aircraft occupants by extending the length of the aisle.

However, in dense smoke conditions, the lighted strip rapidly visually disappears as viewing distance increases and transitions through a series of glowing pinpoints of light until only one pinpoint is visible at a time. If only a single light pinpoint is discernable to an occupant, the location of the next pinpoint of light can only be guessed and the strip of light loses its primary function of marking a path to an emergency exit.

The need for an emergency lighting system that better penetrates smoke and fog to provide a visible and discernable guide to occupant egress from a confined area during an emergency which is functional at distances much greater than prior lighting systems is disclosed in U.S. Pat. No. 5,130,909 to Gross (the inventor herein) and assigned to the assignee herein. A floor-mounted strip of narrow cone angle L.E.D.s are axially aligned and have attached reflectors to direct their emitted light. Alternate L.E.D.s have their light directed in different directions to illuminate the floor in clear air emergency (normal lighting failure) conditions and provide a path marker in conditions of reduced visibility.

However, this emergency lighting strip is most effective near the floor and to a crawling occupant and is less effective for an upright occupant. As such, it is a compromise attempt to provide both illumination and path marking. It requires central floor mounting to be most effective, although floor corner mounting is also described. In buildings, floor mounting is expensive, since it requires carpet cutting and/or floor modification.

There is a need for an emergency lighting strip which marks an emergency egress path in conditions of reduced visibility for an upright escaping occupant.

There is also a need for an emergency lighting strip which provides illumination at the center of an egress passageway during clear air emergency conditions for an escaping occupant.

There is a further need for a single emergency lighting strip which functions to provide both illumination in emergency clear air conditions and path marking in reduced visibility emergency conditions for all escaping occupants.

There is a yet further need for such an emergency lighting strip which is adaptable to a variety of different passageway configurations.

SUMMARY OF THE INVENTION

It is an object of this invention to provide an emergency lighting strip which marks an emergency egress path in conditions of reduced visibility for an upright escaping occupant.

It is another object of this invention to provide an emergency lighting strip which provides illumination at the center of an egress passageway during clear air emergency conditions for an escaping occupant.

It is a further object of this invention to provide a single emergency lighting strip which functions to provide both illumination in emergency clear air conditions and path marking in reduced visibility emergency conditions for all escaping occupants.

It is a yet further object of this invention to provide such an emergency lighting strip which is adaptable to a variety of different passageway configurations.

In accordance with one aspect, this invention features an emergency egress lighting strip for illuminating an egress path in a passageway during conditions of reduced visibility which comprises an elongated transparent housing mounted on a passageway wall and an elongated string of narrow cone angle L.E.D.s mounted within the housing with their beam axes angled outwardly from the wall to provide a series of discrete beamed point sources of light to mark the path.

In one embodiment, the path extends along the passageway leading to an exit portal, and the strip extends along the passageway wall leading to the portal, the L.E.D.s each having their beam axes angled upwardly from the horizontal.

In another embodiment, the path extends through an exit portal in a wall of the passageway, the strip is provided on the wall framing the portal, and the L.E.D.s have their beam axes angled substantially perpendicular to the wall.

In accordance with another aspect, this invention features an emergency egress lighting strip for illuminating a passageway during clear air conditions and for marking an egress path along the passageway during conditions of reduced visibility. The strip comprises an elongated transparent housing mounted on a passageway wall above the floor, and first and second strings of light emitting elements mounted within the housing, each being an intense point source of light which emit light along its beam axis at a narrow cone angle. The beam axes of the first string of elements are angled downward from the horizontal to illuminate a passageway, while the beam axes of the second string of elements are upward from the horizontal. The first string provides illumination at the center of the passageway floor of at least 0.2 lux under emergency clear air conditions, and the second string provides a series of beamed point sources of light which mark an egress path for said occupants along the passageway in conditions of reduced visibility.

Preferably, the light emitting elements are L.E.D.s, each having a cone angle of not more than 45° and an intensity of at least 0.035 candela.

In a further aspect, this invention features a housing having a part-circular cross-section and the strings of L.E.D.s are mounted on a bracket within the housing. This part-circular housing cross-section enables rotation of the L.E.D. mounting bracket within the housing to accommodate various mounting locations of the strip on the wall.

Preferably, the mounting bracket includes a pair of legs arranged to mount the strings of L.E.D.s in a 90° L shape extending across each other; the second string L.E.D.s are spaced four inches apart and the first string L.E.D.s are spaced one-half inch apart, with an L.E.D. omitted at the location of each second string L.E.D.

Preferably, the first string L.E.D.s provide illumination at the center of the floor of the passageway of at least 1 lux under emergency clear air conditions.

BRIEF DESCRIPTION OF THE DRAWINGS

FIG. 1 is a perspective view of a portion of a building incorporating one form of emergency lighting strip according to this invention;

FIG. 2 is a partial perspective view of a portion of the emergency lighting strip of FIG. 1, sectioned to illustrate construction details;

FIG. 3 is an end view of the emergency lighting strip of FIG. 2, illustrating the relationship between the marker and illuminator strings of L.E.D.s;

FIG. 4 is an elevation of the emergency lighting strip of FIG. 2, illustrating the spacing of the L.E.D.s in the illuminator string; and FIG. 5 is another elevation of the emergency lighting strip of FIG. 2, illustrating the spacing of the L.E.D.s in the marker string.

DETAILED DESCRIPTION OF A PREFERRED EMBODIMENT

Referring now to FIG. 1 of the drawings, a structure 10, such as an office building, includes a passageway or hallway 12 that leads to an exterior-access exit door 14 in 15 a building wall 16. Hallway 12 is defined by interior walls 18, 20, 22, 24, 26, 28 which line its floor 30. As illustrated here, the only access exteriorly of building 10 available to occupants is through exit door 14.

Large structures, such as office buildings and hotels, often contain a "maze" of corridors and hallways that are easily traversed only by frequent occupants who have memorized their layout. Occasional occupants and visitors (or guests in the case of a hotel) can normally find their way only with the help of unlighted instructional signs. As mandated by local fire codes, illuminated "EXIT" signs usually are provided at ceiling level and at intervals to indicate an emergency egress path along a passageway, such as hallway 12. These signs are aesthetically undesirable (i.e have a high "ugly" index) and are expensive.

During a clear emergency, normally accompanied by a power failure and consequent failure of normal building lighting, these normal "EXIT" signs are clearly visible if they are within sight. They also normally incorporate downward incandescent light which provides intermittent "islands" of illumination in the form of spaced pools of floor lighting. To assure constant visibility and better intermittent floor illumination in a building having a "maze" of hallways, a very large number of "EXIT" signs would be required, much to the aesthetic detriment of the building.

These normal "EXIT" signs are actually of very limited, if any, utility in the case of a fire that generates significant smoke, as is the usual case. These illuminated signs rapidly become all but invisible at any appreciable distance. This occurs because the signs are usually backlit and thus emit light hemispherically. As the photons of this emitted light encounter the particulate matter comprising the smoke, they are randomly scattered and absorbed. Since the smoke is hot, it is densest near the ceiling where the signs are located and visibility of the signs quickly diminishes, as the smoke thickens. Also, all floor illumination is lost for the same reason.

Thus, it is all too probable that building occupants would be unable to discern these "EXIT" signs and could wander aimlessly through the maze of unfamiliar hallways in search of an exit to escape from the building and its fire.

As the smoke thickens, occupants are forced to move nearer floor 30 where the smoke is least dense and where the supply of oxygen is greatest. This would, however, move the occupants even further from the overhead "EXIT" signs. To enhance the occupants' ability to quickly locate and utilize hallway 12 as an egress passageway along an emergency escape path to the exit portal door 14, in the case of fire or other emergency, this invention provides an emergency lighting strip 40.

Referring now to FIGS. 2 and 3, emergency lighting strip 40 comprises an assembly 42 of an illuminating string 44 of L.E.D.s 46 and a marker string 48 of L.E.D.s 50. Strings 44 and 48 are mounted on a plastic (insulating) mounting bracket 52 having an angular J shape and including L.E.D. mounting legs 54 and 56, arranged in a 90° L shape. L.E.D.s 46 and 50 of strings 44 and 48 cross with and project light in a narrow cone angle about their beam axes X and Y, which form an included angle $\alpha$, illustrated here as 90°.

Marker L.E.D.s 50 in string 48 project through apertures in a light barrier leg 58 of mounting bracket 52. Leg 58 serves to isolate the light from illuminator string 44 so that it will not provide a background glow which would submerge the discrete beamed point sources of light produced by L.E.D.s 50 of marker string 48.

L.E.D.s 46 and 50 are all preferably green, have an output of at least 0.035 candela, and have a narrow cone angle, i.e. not larger than 45°. Larger L.E.D.s, such as those having an output of 0.12 candela and a cone angle of 24° can also be used. Those L.E.D.s having larger cone angles and smaller output function best as illuminators, while those with smaller cone angles function best as markers, penetrating smoke better. Different size L.E.D.s could be used on the same or on different strings, although this will complicate power supply.

L.E.D.s 46 each include electrical leads **46*a* and 46*b* which are attached to conductors 54*a* and 54*b* on bracket leg 54. Similarly, L.E.D.s 50 each have electrical leads 50*a* and 50*b* which attach to conductors 56*a* and 56*b* on bracket leg 56**. Both strips of L.E.D.s are powered by a suitable emergency d.c. power supply, the size of which is dependent on how many and what power L.E.D.s are connected to it and to other environmental factors well known in the art of emergency illumination and power supply.

A strip of wall molding 60 is attached to walls 18–28 at a point above floor 30. The elevation distance d (FIG. 1) above the floor is dependent on the illumination requirements, the width of the emergency egress passageway (here hallway 12), and L.E.D. size used in illuminating string 44. Aesthetically, it would be desirable to incorporate strip 40 as the top portion of a baseboard 70 on the walls (FIG. 1).

Wall molding 60 includes a base portion 62 and inwardly-angled side portions 64 and 66, having locking tangs 67 and 68. L.E.D. mounting bracket 52 is attached to an attachment strip 72 that is adhesively or otherwise attached to molding base 62. After attaching attachment strip 72 to molding 60, a transparent plastic housing 74, having a part-circular cross-section, is attached, via interengagement of its locking tangs 77 and 78 with respective locking tangs 67 and 68.

The part-circular shape of the cross-section of housing 74 enables a common housing to be utilized regardless of the angular orientation of L.E.D. strings 44 and 48. Housing 74 can be of any transparent material.

FIGS. 4 and 5 illustrate the close spacing of the L.E.D.s in illuminating string 44, preferably one-half inch, which provides the desired floor illumination. Every eighth illuminator L.E.D. 46 is missing to provide space for a marker L.E.D. 50. FIG. 4 shows the wide spacing A, preferably four inches, of the L.E.D.s in marker string 48. This wide spacing provides discrete beamed point sources of light which are more distinct and, thus, more readily discernible by observers in heavy smoke, or other conditions of reduced visibility, than would be the case with more closely spaced L.E.D.s. This spacing reduces the amount of light scatter around each L.E.D. which tends to submerge each discrete beamed point source of light into the background light "noise".

While it is preferable to mount both the marker string 48 of L.E.D.s 50 and the illuminator string 44 of L.E.D.s 46 within housing 74, either string may be used separately. For example, FIG. 1 shows an inverted U-shaped marker strip of L.E.D.s 80 mounted on wall 16 framing exit door 14. This strip preferably contains only a single string of L.E.D.s spaced one-half inch apart and mounted with their beam axes perpendicular to wall 16. This strip 80 provides a very bright marker for exit door 14. Since strip 80 does not mark a path along hallway 12, the distinctness of the individual L.E.D.s is not needed.

Of course, if only a marker emergency light strip is desired, marker string 48 may be mounted alone in housing 74 extending along hallway 12. Similarly, if only clear emergency illumination is required, illuminator string 44 may be mounted alone in housing 74 to illuminate hallway floor 30. Again, because of the circularity of housing 74, these single strings may be oriented in any angular position. Thus, the mounting bracket, molding, housing and attachment strip are common to any marker, illuminator or combination application of the emergency lighting strip.

As stated above, the choice of mounting height, beam axis angles and L. E. D. size are dependent on environmental considerations. These factors are combined to provide an emergency lighting strip which meets mandated illumination requirements at the middle of floor 30 in hallway 12 (centerline in FIG. 1 ) . Currently, British requirements are 0.2 lux, although developing European requirements recite an illumination at passageway floor middle of 1 lux.

Applicant has conducted preliminary human observation testing with a 6-foot strip of lighting strip as described above, utilizing the 0.035 candela L.E.D.s at the indicated spacing, with the strip mounted at an above-floor height of about ten inches (150 mm). In clear air conditions and at a power of about 13 mA per L.E.D. , illumination of the passageway floor exceeded 0.2 lux to a distance of about three feet (900 mm). Thus this strip would meet British requirements in a six-foot wide hallway.

In testing in various visibility conditions in simulated smoke (from mild to dense), the marker L.E.D.s were observed by two upright observers. At 27% visibility (clear air=100%), the marker string was discernible to two observers at a distance of 1.75 m by one and at 2.2 m by the other. This illustrates that, in a six-foot hallway, the emergency lighting strip is able to mark an escape path for an upright observer walking in the middle of the hallway in dense smoke conditions.

Thus, an emergency lighting strip according to this invention provides an emergency lighting strip which marks an emergency egress path in conditions of reduced visibility for an upright escaping occupant. It also provides an emergency lighting strip which provides illumination at the center of an egress passageway during clear air emergency conditions for an escaping occupant. Further, it provides a single emergency lighting strip which functions to provide both illumination in emergency clear air conditions and path marking in reduced visibility emergency conditions for all escaping occupants. Yet further, it provides an emergency lighting strip which is adaptable to a variety of different passageway configurations.

While only a preferred embodiment has been illustrated and described, obvious modifications are contemplated within the scope of this invention and the following claims. For example, emergency lighting strip 40 could be mounted in ship passageways, aircraft cabins, train hallways, bus cabins, or in any other large environment whose occupants cannot easily identify an emergency escape path in clear air or, especially, in conditions of limited visibility. The strings of L.E.D.s could have their L.E.D.s differently spaced or unequally spaced. The strings could incorporate different size L.E.D.s, which could alter spacing. The angle between the beam axes of the two strings could be other than as illustrated. It is only necessary to have L.E.D.s or other light sources having narrow cone angles and sufficient power to be visible in conditions of reduced visibility and to illuminate the middle of a corridor floor in clear air.

We claim:

1. An emergency egress lighting strip for illuminating an emergency egress path on a passageway floor during conditions of reduced visibility, comprising an elongated transparent housing mounted on a passageway wall and an elongated string of narrow cone angle L.E.D.s mounted within the housing with their beam axes angled outwardly from the wall, each L.E.D. being an intense point source of light which emits light along its beam axis at a narrow cone angle not greater than 45° to provide discrete projected point sources of light to mark the path on the passageway floor.

2. The lighting strip of claim 1, wherein the path extends along a passageway leading to an exit portal, and the strip extends along a passageway wall leading to the portal, the housing including further L.E.D.s each having their beam axes angled upwardly from the horizontal.

3. The lighting strip of claim 2, wherein a second strip is provided on a wall framing a portal, the second strip comprising an elongated transparent housing containing a second string of narrow cone angle L.E.D.s mounted within the housing with their beam axes angled outwardly from the wall.

4. The lighting strip of claim 3, wherein the L.E.D.s of the second strip have their beam axes angled substantially perpendicular to the wall.

5. The lighting strip of claim 4, wherein the L.E.D.s of the first string are spaced at four inch intervals along the strip, and the L.E.D.s of the second string each have a full cone angle no greater than 45 degrees and are spaced at one-half inch intervals along the strip.

6. An emergency egress lighting strip for marking an illuminating an egress path in a passageway, comprising an elongated transparent housing mounted on a passageway wall, a first elongated string of narrow cone angle L.E.D.s mounted within the housing with their beam axes angled upwardly from horizontal, and a second string of narrow cone angle L.E.D.s mounted within the housing with their beam axes angled downward from horizontal.

7. The lighting strip of claim 6, wherein the transparent housing has a part-circular cross-section.

8. The lighting strip of claim 7, wherein the string of L.E.D.s are mounted on a bracket within the housing, said part-circular housing cross-section enabling the use of a variety of different L.E.D. mounting brackets within the housing to provide a variety of different angular positions of the string of L.E.D.s to accommodate various mounting locations of the strip on the wall while utilizing a common housing.

9. The lighting strip of claim 8, wherein the mounting bracket includes a pair of legs arranged to mount the strings of L.E.D.s in an L shape extending across each other.

10. The lighting strip of claim 9, wherein the first string omits an L.E.D. at the location of each second string L.E.D.

11. The emergency egress lighting strip of claim 1, wherein the axes of the L.E.D.s are angled downward from the horizontal to project light to provide illumination at the center of the passageway floor of at least 0.2 lux under emergency clear air conditions.

12. The lighting strip of claim 11, wherein the light projected by the L.E.D.s of the strip provide illumination at the center of the passageway floor of at least 1 lux under emergency clear air conditions.

13. The lighting strip of claim 12, wherein the L.E.D.s have their beam axes angled 45° downward from the horizontal.

14. The lighting strip of claim 11, wherein the L.E.D.s are spaced at least one-half inch apart along the strip.

15. The lighting strip of claim 11, wherein the transparent housing has a part-circular cross-section.

16. An emergency egress lighting strip for marking an emergency egress path along a passageway for occupants of a structure during conditions of reduced visibility, comprising an elongated transparent housing mounted on a passageway wall, a string of L.E.D.s mounted within the housing, each of which emit light along its beam axis at a narrow cone angle not greater than 45°, the axes of the L.E.D.s being angled upward from the horizontal, whereby the strip provides a series of discrete point sources of light which are projected outwardly of the wall to mark an egress path for said occupants along the passageway in conditions of reduced visibility.

17. The lighting strip of claim 16, wherein the L.E.D.s are spaced at least four inches apart along the strip.

18. The lighting strip of claim 16, wherein the L.E.D.s have their beam axes angled upward at a 45° angle from the horizontal.

19. The lighting strip of claim 18, wherein the L.E.D.s have an axial intensity of at least 0.035 candela.

20. The lighting strip of claim 16, wherein the transparent housing has a part-circular cross-section.

21. An emergency egress lighting strip for illuminating a passageway during clear air conditions and for marking an egress path along the passageway during conditions of reduced visibility, comprising an elongated transparent housing mounted on a passageway wall above the floor, a first string of light emitting elements mounted within the housing, each being an intense point source of light which emit light along its beam axis at a narrow cone angle, the axes of the elements being angled downward from the horizontal to illuminate a passageway, a second string of light emitting elements mounted within the housing, each being an intense point source of light which emit light along its beam axis at a narrow cone angle, the axes of the elements being angled upward from the horizontal, whereby the first string provides illumination at the center of the passageway floor of at least 0.2 lux under emergency clear air conditions, and the second string provides a series of discrete point sources of light to mark an egress path for said occupants along the passageway in conditions of reduced visibility.

22. The lighting strip of claim 21, wherein the light emitting elements are L.E.D.s.

23. The lighting strip of claim 22, wherein the L.E.D.s of both strings each have an axial intensity of at least 0.035 candela and a full cone angle no greater than 45 degrees.

24. The lighting strip of claim 23, wherein the L.E.D.s of the second string are spaced at least four inches along the strip.

25. The lighting strip of claim 24, wherein the L.E.D.s of the first strip are spaced at least one-half inch apart along the strip.

26. The lighting strip of claim 22 wherein the transparent housing has a part-circular cross-section.

27. The lighting strip of claim 26, wherein the mounting bracket includes a pair of legs arranged to mount the strings of L.E.D.s in an L shape extending across each other, the first string omitting an L.E.D. at the location of each second string L.E.D.

28. The lighting strip of claim 27, wherein L.E.D.s of the second string provide illumination at the center of the floor of the passageway of at least 1 lux under emergency clear air conditions.

29. The lighting strip of claim 28, wherein the mounting bracket legs are angled at 90° to each other.

30. The lighting strip of claim 29, wherein the L.E.D.s of the first string have their beam axes angled upward at a 45° angle from the horizontal.

31. The lighting strip of claim 30, wherein the L.E.D.s each have an axial intensity of at least 0.035 candela and have a full cone angle no greater than 45 degrees.

* * * * *